US009925675B2

(12) United States Patent
Molema et al.

(10) Patent No.: US 9,925,675 B2
(45) Date of Patent: Mar. 27, 2018

(54) LINKAGE UNIT AND HAIR CUTTING APPLIANCE

(71) Applicant: KONINKLIJKE PHILIPS N.V., Eindhoven (NL)

(72) Inventors: Jeroen Molema, Eindhoven (NL); Bram Tuijp, Eindhoven (NL); Geert Willem De Goeij, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/038,353

(22) PCT Filed: Nov. 6, 2014

(86) PCT No.: PCT/EP2014/073882
§ 371 (c)(1),
(2) Date: May 20, 2016

(87) PCT Pub. No.: WO2015/074882
PCT Pub. Date: May 28, 2015

(65) Prior Publication Data

US 2016/0288348 A1 Oct. 6, 2016

(30) Foreign Application Priority Data

Nov. 22, 2013 (EP) ..... 13193972

(51) Int. Cl.
*B26B 19/38* (2006.01)
*B26B 19/04* (2006.01)
*B26B 21/22* (2006.01)

(52) U.S. Cl.
CPC ..... *B26B 19/386* (2013.01); *B26B 19/042* (2013.01); *B26B 19/048* (2013.01); *B26B 19/3846* (2013.01); *B26B 21/225* (2013.01)

(58) Field of Classification Search
CPC . B26B 19/386; B26B 19/042; B26B 19/3846; B26B 19/048
See application file for complete search history.

(56) References Cited

U.S. PATENT DOCUMENTS 2,102,529 A 12/1937 Hanley
2,151,965 A 3/1939 Hanley
2,290,326 A 7/1942 Hanley
4,797,997 A * 1/1989 Packham ..... B26B 19/046 30/43.1

(Continued)

FOREIGN PATENT DOCUMENTS

EP 0267044 A1 5/1988
EP 1621299 A1 5/1988

(Continued)

*Primary Examiner* — Hwei C Payer

(57) ABSTRACT

A hair cutting appliance includes a linkage unit configured to couple a cutting unit and to a housing of the hair cutting appliance. The linkage unit includes a four-bar linkage mechanism having first and second arms which respectively include first and second bases pivots coupled to a base. The first and second base pivots are arranged at the base at a fixed distance. The first arm and second arms also respectively include first and second top pivots coupled to a connecting bar. The connecting bar is configured to be coupled to the cutting unit such that, during operation, the cutting unit is pivotably supported by the four-bar linkage mechanism.

17 Claims, 7 Drawing Sheets

(56) References Cited

U.S. PATENT DOCUMENTS

| | | | | |
|---|---|---|---|---|
| 5,611,145 | A * | 3/1997 | Wetzel | B26B 19/044 30/43.92 |
| 5,661,907 | A | 9/1997 | Apprille | |
| 5,704,126 | A * | 1/1998 | Franke | B26B 19/046 30/34.1 |
| 5,787,593 | A * | 8/1998 | Althaus | B26B 21/225 30/527 |
| 5,802,932 | A | 9/1998 | Vankov | |
| 6,308,416 | B1 | 10/2001 | Bosy | |
| 7,137,205 | B2 * | 11/2006 | Royle | B26B 21/225 30/50 |
| 7,162,801 | B2 * | 1/2007 | Royle | B26B 19/048 30/43.92 |
| 7,841,090 | B2 * | 11/2010 | Eichhorn | B26B 19/048 30/346.51 |
| 8,347,508 | B2 * | 1/2013 | Shimizu | B26B 19/048 30/45 |
| 9,399,302 | B2 * | 7/2016 | Shimizu | B26B 19/048 |
| 2002/0011683 | A1 | 1/2002 | Gadkaree | |
| 2003/0213130 | A1 * | 11/2003 | Motta | B26B 21/225 30/50 |
| 2011/0094107 | A1 | 4/2011 | Ring | |
| 2013/0160306 | A1 | 6/2013 | Howell | |
| 2016/0271815 | A1 * | 9/2016 | Molema | B26B 19/048 |
| 2016/0288348 | A1 * | 10/2016 | Molema | B26B 19/048 |
| 2017/0120466 | A1 * | 5/2017 | Phoon | B26B 19/28 |

FOREIGN PATENT DOCUMENTS

| | | | |
|---|---|---|---|
| EP | 1547735 | A1 | 6/2005 |
| WO | 0038893 | A2 | 7/2000 |
| WO | 2010000352 | A2 | 1/2010 |
| WO | 2013095949 | A1 | 6/2013 |
| WO | 2013150412 | A1 | 10/2013 |
| WO | 2015075160 | A1 | 5/2015 |
| WO | WO 2015/074882 | A1 * | 5/2015 |

* cited by examiner

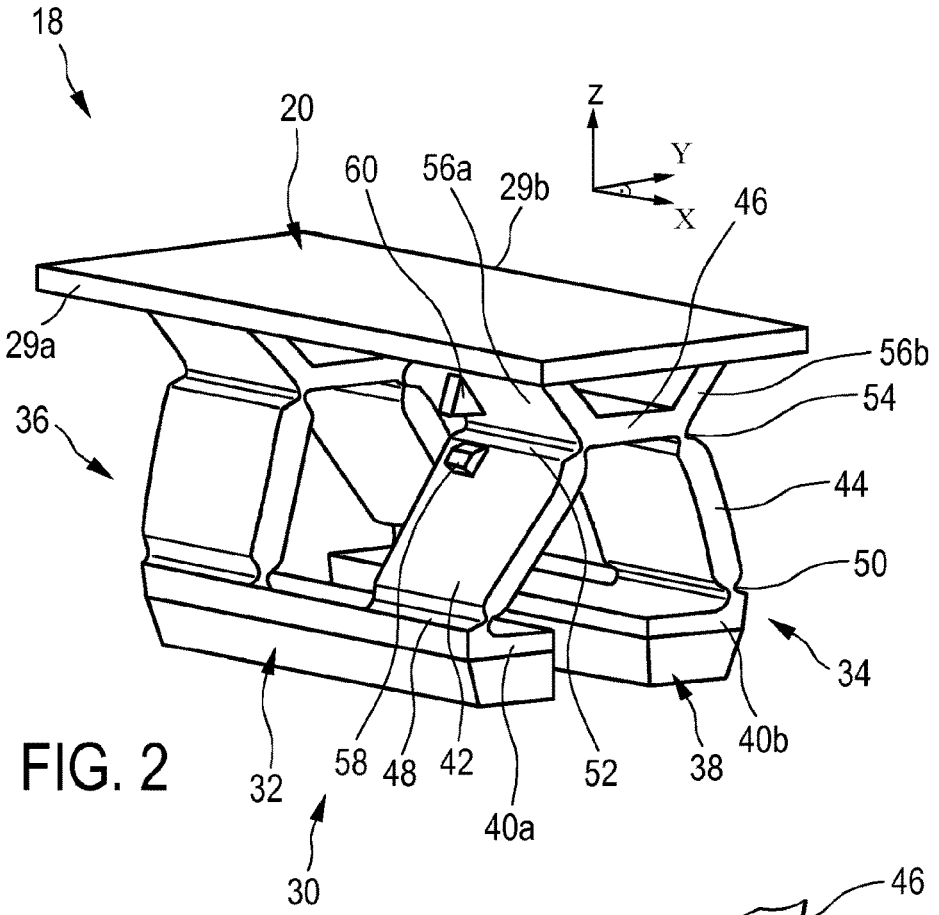
FIG. 2
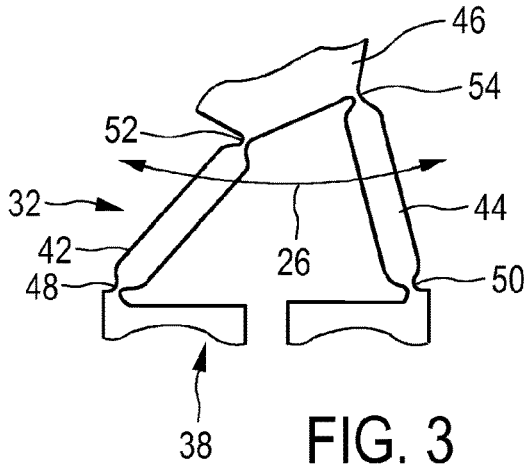
FIG. 3
FIG. 4
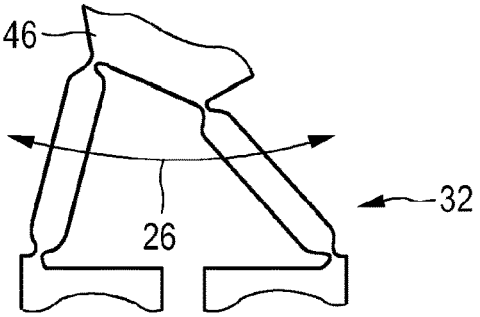

LINKAGE UNIT AND HAIR CUTTING APPLIANCE

This application is the U.S. National Phase application under 35 U.S.C. § 371 of International Application No. PCT/EP2014/073882, filed on Nov. 6, 2014, which claims the benefit of International Application No. 13193972.0 filed on Nov. 22, 2013. These applications are hereby incorporated by reference herein.

FIELD OF THE INVENTION

The present disclosure relates to a hair cutting appliance, particularly to an electrically operated hair cutting appliance and more particularly to a cutting unit and a linkage unit for coupling the cutting unit and a housing of a hair cutting appliance. The cutting unit may comprise a blade set, and may be arranged to be moved through hair in a moving direction to cut hair. The blade set may comprise a stationary blade and a movable blade, wherein the movable blade may be moved with respect to the stationary blade so as to cut hair trapped there between.

BACKGROUND OF THE INVENTION

WO 2010/000352 A2 discloses an electrical hair removing appliance comprising a handpiece that extends in the direction of a center axis and that is provided with a front side and a rear side as well as with side faces, and comprising a operating head fastened to the handpiece via a retaining device, the operating head having a operating unit that comprises at least one operating element that is set into motion via an operating element by an electric drive motor formed in the appliance, such that when the operating unit glides along the skin surface of a user, hair is removed by the operating unit, wherein the retaining device is connected to the handpiece via guide means in such a way that when a force acts on the operating head in the guiding direction, at least a lateral displacement of the operating relative to the handpiece may occur.

WO 00/38893 A2 discloses a shaving razor comprising a handle, first, second and third blade units that are mounted at the end of said handle, each said blade unit including a guard, at least one blade having a cutting edge, and a cap, and a mounting structure connecting each said blade unit to said handle, said mounting structure providing a pivotal connection of said blade unit to said mounting structure about a pivot axis that is transverse to the cutting edge, and also providing up and down movement of said blade unit along a displacement direction that is transverse to a plane through the guard and cap, thereby permitting each said blade unit to conform to the contour of a surface being shaved.

WO 2013/150412 A1 discloses a hair cutting appliance and a corresponding blade set of a hair cutting appliance. The blade set comprises a stationary blade and a movable blade, wherein the movable blade can be reciprocatingly driven with respect to the stationary blade for cutting hair. The blade set is particularly suited for enabling both trimming and shaving operations.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra-thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes generally two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

Unfortunately, common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small circular perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that often prevents hair from being cut off close to the skin. Consequently, a user desiring to both shave and trim his body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembling processes. Similarly, operating these combined devices is often experienced to be rather uncomfortable and complex. Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

The above WO 2013/150412 A1 tackles this issue by providing for a blade set comprising a stationary blade that houses the movable blade such that a first portion of the stationary blade is arranged at the side of the movable blade facing the skin when in use, and that a second portion of the stationary blade is arranged at the side of the movable blade facing away from the skin when in use. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

This arrangement is advantageous insofar as the stationary blade may provide the blade set with increased strength and stiffness since the stationary blade is also present at the side of the movable blade facing away from the skin. This may generally enable a reduction of the thickness of the first portion of the stationary blade at the skin-facing side of the movable blade. Consequently, since in this way the movable blade may come closer to the skin during operation, the above blade set is well-suited for hair shaving operations. Aside from that, the blade set is also particularly suited for hair trimming operations since the configuration of the cutting edge, including respective teeth alternating with slots, also allows for longer hairs to enter the slots and, consequently, to be cut by the relative cutting motion between the movable blade and the stationary blade.

SUMMARY OF THE INVENTION

The cutting appliance known from the WO 2013/150412 A1 is particularly suited for both trimming and shaving operations but does not address shaving performance peculiarities and practical use aspects for shaving operations. For instance, when shaving facial hair, account should be taken of the basically uneven contour of the skin surface. For optimizing the shaving performance, the blade set should be guided at a predefined angle with respect to the current skin portion. This may complicate the handling of such a hair cutting appliance.

It is an object of the present disclosure to provide for a hair cutting appliance, particularly for a linkage unit for a cutting unit thereof, exhibiting an improved shaving suitability. Particularly, a linkage unit may be presented that may simplify contour following when shaving hair at the level of the skin. More preferably, handling the hair cutting appliance during use shall be improved. Advantageously, the linkage unit may contribute to a reduction of the risk of skin cuts and/or similar injuries. More preferably, it would be advantageous to provide for a linkage unit that can be produced with minor effort. Even more preferably, the hair cutting appliance is also suited for precise styling operations.

In a first aspect of the present disclosure a combination comprising a cutting unit and a linkage unit for a hair cutting appliance is presented, wherein the cutting unit is arranged to be coupled to a housing of the hair cutting appliance by the linkage unit, the cutting unit comprising a blade set comprising a stationary blade, a movable blade and at least one basically longitudinally extending cutting edge, wherein the stationary blade is arranged to house and to guide the movable blade for longitudinal movement with respect to the stationary blade, the stationary blade comprising a cross-section, viewed in a plane perpendicular to a lateral direction Y, that is basically U-shaped, particularly at the at least one cutting edge, wherein the U-shaped form comprises a first leg and a second leg, wherein a guiding slot for the movable blade is provided between the first leg and the second leg, and wherein the stationary blade basically encloses the movable blade at the side thereof facing the skin when cutting hair and, at least partially, at the side thereof facing away from the skin when cutting hair, the linkage unit comprising a four-bar linkage mechanism, the four-bar linkage mechanism comprising a first arm and a second arm opposite to the first arm, the first arm comprising a first base pivot coupled to a base, the second arm comprising a second base pivot coupled to a base, the first base pivot and the second base pivot being arranged at the base at a defined distance, the first arm further comprising a first top pivot coupled to a connecting bar, the second arm further comprising a second top pivot coupled to the connecting bar, wherein the connecting bar is arranged to be coupled to a cutting unit such that, during operation, the cutting unit is pivotably supported by the linkage mechanism.

This aspect is based on the insight that shaving performance of the hair cutting appliance can be significantly improved by mounting the blade unit in a pivoting manner (or swiveling manner). The cutting unit may comprise a blade set having a skin side that faces the skin when shaving hair and that may comprise a basically planar or substantially flat extension. When the cutting unit is then pivoted at or pivotably connected to the housing of the hair cutting appliance, the contour following capability of the hair cutting appliance may be enhanced since the cutting unit may be somewhat self-aligning at the surface of the skin while performing, at the same time, a compensational relative (swiveling) motion with respect to the housing of the hair cutting appliance. Consequently, a user may grab and hold the hair cutting appliance at its housing in a tight or firm manner without the need to instantly adapt the orientation of the hair cutting appliance to an actual orientation of the skin surface. This may significantly improve the cutting performance while also mitigating the risk of skin irritation or even skin cuts.

Since it is generally desired to reduce the size and the mass of the hair cutting appliance and particularly of the cutting unit thereof, there exist practical design limits for positioning a pivot for the cutting unit. Since the installation space for implementing a single-axis linkage unit, or a circular joint, a knee joint, etc., for the cutting unit might be limited, also a possible range of the area where the swiveling axis can be placed might be limited. Consequently, the mounting of such a conventional cutting unit may be regarded as adversely affecting the contour following capability of the cutting unit since a considerably poor swiveling behavior may occur.

It is therefore particularly preferred to implement a four-bar linkage mechanism for performing the mounting and supporting function. The four-bar linkage mechanism can be designed in a suitable manner, thereby defining a virtual pivot that may also be regarded as a moving (or floating) virtual pivot. By way of example, the four-bar linkage mechanism may be designed such that the virtual pivot is (virtually) arranged at a defined distance from the cutting unit that cannot be achieved with conventional single-pivot coupling mechanisms, given the installation available space. The resulting virtual pivot may be arranged at a portion of the hair cutting appliance that is basically obstructed by further components thereof. Alternatively, the virtual pivot may be arranged "above" the blade set, i.e. below the skin surface, when shaving. Consequently, the pivoting responsivity of the cutting unit when being guided at the skin for shaving skin hairs can be adjusted accordingly. It should be understood in this connection that the virtual pivot in some embodiments may not be regarded as a fixed virtual pivot. Rather, the virtual pivot may be regarded as an instantaneous, actual or current virtual pivot.

The cutting unit in accordance with the above embodiment may be suitably adapted for both shaving and trimming operations. Shaving performance may be improved by the layered structure of the stationary blade including a first wall portion which may be referred to as skin-sided portion and a second wall portion which may be referred to as portion facing away from the skin. This may have the major advantage the the blade set may be significantly thin, particularly at the skin-sided portion thereof and, at the same time, considerably rigid, due to the presence of the wall portion at the side facing away from the skin. Since the second wall portion provides the stationary blade with sufficient stiffness, the thickness of the first wall may be significantly reduced which allows to cut even shorter hairs when shaving. The improved stiffness of the blade set may have the further advantage that attachment combs may be attached/coupled thereto so that the cutting unit is also suitably arranged for trimming hairs (to a desired hair length that can be defined by the comb). The designation of the above portions (skin-side and side facing away from the skin) may be defined when the blade set is used for shaving and guided along the skin of the user.

The above embodiment may have the further advantage that the reduced overall thickness of the blade set further increases the degree of design freedom for the definition of the position and/or positional ranges of the virtual pivot that may be defined by the four-bar linkage mechanism. Consequently, the contour-following capability of the cutting unit may be even further enhanced. Generally, the cutting unit and the linkage unit may form a set that is attachable to the housing of the hair cutting appliance. In the set, the the cutting unit and the linkage unit may be present as separate components that are connectable to one another. In the alternative, the set may comprise the cutting unit and the linkage unit that are present in a joined or connected state.

In a preferred embodiment, the four-bar linkage mechanism defines a virtual pivot for the cutting unit, the virtual pivot comprising a virtual pivot axis p that is substantially parallel to a cutting edge of the cutting unit. Preferably, the pivot axis may be arranged in the vicinity of a top surface of the cutting unit facing away, when mounted, from the housing of the hair cutting appliance, wherein the pivot axis p is offset from the top surface, in a neutral position of the four-bar linkage mechanism, by a pivot offset dimension $l_o$ in the range of about −2.0 mm to about +5.0 mm, preferably in the range of about −1.0 mm to about +2.0 mm, more preferably in the range of about +0.25 mm to about +0.75 mm. So the cutting unit may swivel about an axis that is substantially perpendicular to an assumed moving direction of the hair cutting appliance when cutting hair. It is further preferred that the virtual pivot is offset from a skin-facing plane, also referred to as top surface, defined by the cutting edges of the cutting unit, preferably towards the skin, when in use. However, in some alternative embodiments, the virtual pivot may be arranged above the skin level, i.e., rearwardly shifted from the skin-facing plane defined by the cutting edges of the cutting unit.

The neutral position may be regarded as the position of the linkage mechanism where the blade unit is basically centered. In other words, the blade unit may be, in the neutral position, substantially parallel to the base or, more explicitly, substantially parallel to a plane defined by the first base pivot and the second base pivot. Put differently, the neutral position of the linkage mechanism may be regarded as the position occupied by the linkage mechanism in the center or middle portion of the swiveling range.

It is particularly preferred that at least one of, preferably each of, the first and second base pivots and the first and second top pivots is arranged as a living hinge. A living hinge may also be regarded as flexure bearing that is made from the same material as the parts that are connected in pivoting manner by the living hinge. It is further preferred in this regard that all pivots of the four-bar linkage mechanism are arranged as living hinges, particularly as film hinges. Film hinges or thin-film hinges may be manufactured, for instance, via an injection molding process. Consequently, at least one of the pivots and the respective neighboring parts connected by the pivot can be produced from basically the same material in an integral manner. This arrangement may further ensure that substantially no (mechanical) play is present in the pivots. Mechanical joints that are composed of separate components are typically designed in a clearance-fit manner including a defined play so as to allow a smooth pivoting motion. Moreover, film hinges may further have the advantage that any (internal) pollution of the joints can be prevented. According to another advantageous embodiment at least the first arm, the second arm and the connecting bar of the four-bar linkage mechanism and their respective base pivots and top pivots are integrally formed as a single piece.

This may be beneficial insofar as the four-bar linkage mechanism can be produced in basically a single production step. Particularly, time-consuming assembly steps can be avoided. It is further preferred in this regard that also the base of the four-bar linkage mechanism is at least partially integrated into the single piece shape.

In some embodiments, the base connecting the first arm and the second arm may be composed of two separate base portions. Alternatively, the same may apply to the connecting bar connecting the first arm and the second arm at their top pivots. Also the connecting bar may be composed of two separate connecting bar sections. However, in the alternative, at least one or each of the connecting bar and the base may be composed of a single continuously extending component.

It is particularly preferred in some embodiments that the four-bar linkage mechanism comprises two sections at respective lateral ends of the linkage unit. More preferably, the two sections are laterally spaced apart from each other and connected to a common base. This embodiment is beneficial since in this way a clearance between the two sections may be provided that can be used for housing further components of the appliance, such as a drive mechanism for driving the cutting unit, particularly for driving the movable blade of the blade set. Composing the four-bar linkage mechanism of two sections that may be basically mirror-symmetric with respect to a central axis that is parallel to a longitudinal direction X may further enhance the flexibility and contour following capability of the cutting unit. Generally, it is desired that the linkage mechanism may be arranged to swivel about an axis that is parallel to the pivots defined by the film hinges. Film hinges are, on the one hand, basically designed for pivoting or swiveling about an axis that is defined by a thinned material section. However, since film hinges as such are typically made from considerably elastic material, the film hinges may also be moved, bent or deflected in other ways in response to respective external loads. Consequently, the cutting unit can be guided at the skin with far more flexibility, compared to conventional pivoting mechanisms for the cutting units of hair cutting appliances. In yet another embodiment, the four-bar linkage mechanism is an integrally formed injection molded plastic part. Preferably, plastic resins, such as polyethylene, polypropylene and similar materials having a sufficient fatigue resistance, may be used and processed for manufacturing the integrated four-bar linkage mechanism.

It is further preferred in this regard that the four-bar linkage mechanism is a three-dimensional near-net shaped molded part, wherein the hinges forming the pivots thereof are basically unbiased when the linkage mechanism is in a neutral (or centered) position. As used herein, a near-net shape may be regarded as a shape of the molded part that is equivalent to or, at least, comes closed to the end shape without a need of further costly manufacturing processes. Furthermore, the neutral position may be regarded as the position assumed by the hinges when no load is acting thereon. As used herein, the unbiased state of the pivots may be regarded as the state where no, or only relatively small, inner tensions and strains are present. This may increase the lifespan of the linkage mechanism, i.e. the number of load cycles the linkage mechanism may endure during operation. As used herein, the neutral position may also be referred to as middle position. Consequently, also in respective extreme swiveling positions of the linkage mechanism, also referred to as start and/or end position, only limited inner strain and tensions may be generated since respective tensions are merely added to a considerably low strain level in the neutral position. Furthermore, since an overall tension level may be generally low, a broader range of materials may be used when manufacturing the linkage mechanism. Also the use of low cost materials, e.g. low cost plastics, that may have reduced strength and resilience properties (in contrast to high cost materials) may be permitted in this way.

The near-net shaped molded linkage mechanism may be shaped as a closed structure which may also be referred to as a closed chain. A closed structure of the linkage mechanism may comprise an embodiment wherein any neighboring pivots of the four-bar linkage mechanism are directly connected to each other via the four-bar linkage mechanism. By contrast, in some embodiments, the near-net shaped molded part may be shaped as an open structure which may also be referred to as an open chain. An open structure, as used herein, may be regarded as an embodiment of the four-bar linkage mechanism, wherein at least two neighboring pivots of the four pivots of the four-bar linkage are not directly connected to each other via the four-bar linkage mechanism, i.e., at least one of the first arm, the second arm, the connecting bar and the base is composed of two respective separate portions.

In an alternative embodiment, the four-bar linkage mechanism may be arranged as a bent part that is obtained from an injection molded flat intermediate arrangement, wherein the hinges forming the pivots thereof are basically biased when the linkage mechanism is in a neutral position. Consequently, injection molding the four-bar linkage mechanism can be further simplified, at the cost of another distinguished manufacturing step, namely a bending or deforming process so as to transform the basically flat intermediate arrangement into the three-dimensional shape.

It may be further preferred that the length of the base, defined by a distance between the first base pivot and the second base pivot, is greater than the length of the connecting bar, defined by a distance between the first top pivot and the second top pivot. The virtual pivot axis p may be shifted upwards in this way, preferably above the level of the top surface or, in other words, into the skin. It goes without saying that the first arm and the second arm preferably may have substantially the same length, defined by a distance between their respective pivots.

It may be further beneficial that, at least in some embodiments, the sum of the lengths of the first arm and the second arm is greater than the sum of the lengths of the connecting bar and the base. In other words, the four-bar linkage mechanism may be arranged as a double-rocker mechanism. As used herein, the respective lengths are typically related to a distance between two neighboring pivots defined by the respective hinges. Arranging the four-bar linkage mechanism as double-rocker mechanism may enable a smooth skin-contour following motion of the cutting unit, particularly when cutting facial hair.

According to a further embodiment the linkage unit further comprises at least one biasing element that urges the four-bar linkage mechanism into a start position. It is particularly preferred in this regard that the four-bar linkage mechanism is urged into the start position without play. The at least one biasing element may be defined and selected such that a defined restoring force is present that basically permanently urges the cutting unit into the start position. The restoring force is preferably small enough to be easily surmounted during operation of the hair cutting appliance, when the cutting unit is guided at the skin contour, for instance at a basically curved neck portion or chin portion thereof. Consequently, the linkage unit may be basically self-aligning with respect to the skin and, furthermore, self-restoring, just after an external load or force has been released.

It is further preferred in this regard that the linkage unit comprises a first biasing element and a second biasing element that is arranged opposite to the first biasing element, wherein the first biasing element is coupled to the first arm, wherein the second biasing element is coupled to the second arm, and wherein the first biasing element and the second biasing element urge the first arm and the second arm in opposite directions. The second biasing element may be selected such that the force generated by the first biasing element is generally greater than the force generated by the second biasing element. Consequently, the four-bar linkage mechanism may be retained in the start position in a force-fit manner. The two biasing elements may be defined and selected such that they are slightly biased in the start position. When the blade set is moved to a corresponding end position, at least the biasing force of the first biasing element and, consequently, the restoring force may increase accordingly.

It is even further preferred that the at least biasing element is a torsion bar spring arranged at the base, the torsion bar spring comprising a portion bar pivotably received at the base, the torsion bar being arranged between a first leg and a second leg, wherein the first leg is coupled to the base, and wherein the second leg is coupled to one of the first arm and the second arm. The first leg of the torsion bar spring may be fixed at the base against rotation. To this end, a respective abutment portion may be present at the base. It is particularly preferred that the torsion bar spring, particularly the torsion bar thereof, is arranged in the vicinity of the transition between one of the first arm and the second arm and the base. In other words, a central portion of the base and the connecting bar is preferably not obscured by the at least one biasing element. Consequently, sufficient design space is provided in the central portion that may house a drive mechanism of the hair cutting appliance that is adapted to drive a movable blade of the blade set of the cutting unit with respect to stationary blade thereof.

In yet another embodiment, the linkage unit further comprises at least one end stop element for preventing undesired motion of the four-bar linkage mechanism. The at least one end stop element may be arranged such that excessive motion at the living hinges may be prevented. Generally, the at least one end stop element may be shaped as a separate part or as a part integrated into the four-bar linkage mechanism. Particularly, the at least one end stop element may limit the swiveling angle of the cutting unit. In some embodiments, the total swiveling angle of the blade set of the cutting unit may be in the range of about 45° (degrees). In other words, this may include a swiveling angle of about −22.5° and +22.5° with respect to a middle position (or neutral position). The total swiveling angle may be defined in a different way, also in a non-symmetric way. It may be generally preferred that the total swiveling angle is in the range of about 30° to about 60°. In some embodiments, the total swiveling angle may be in the range of about 40° to 50°. In some embodiments, the total swiveling angle may be in the range of about 42° to 48°.

It may be further preferred in this connection that the at least one end stop element cooperates with at least one biasing element, wherein a resulting biasing force urges the four-bar linkage mechanism against at least one of the at least one end stop element. In this way, a defined start position for the cutting unit may be adopted. It may be further preferred in this regard, with the blade set slightly biased into the start position by the at least one biasing element, that the blade set may swivel between the defined start position and an end position that is defined by another one of the at least one end stop element when in operation. The at least one biasing element may constantly urge the blade set so that the blade set is basically self-returning to the defined start position when external loads are removed.

It may be further preferred that the at least one end stop element is connected to the base and arranged to limit the guided motion of the cutting unit. The at least one end stop element may be particularly arranged to limit the motion of at least one of the first and the second arm, and the connecting bar. The at least one end stop element may be suitably designed to limit the motion of the connecting bar, either directly or indirectly. For instance, the at least one end stop element may be configured to limit the swiveling angle of at least one of, preferably of each of, the first arm and the second arm. Alternatively, the at least one end stop element may be configured to directly contact the connecting bar, or the cutting unit attached thereto, to limit the respective swiveling or pivoting motion about the virtual pivot axis.

The above embodiment may be further detailed in that the at least one end stop element is arranged at an end stop support comprising at least one end stop beam, wherein the at least one end stop beam comprises at least one end face, wherein the at least one end face preferably abuts a bottom side of the cutting unit for limiting the motion of the cutting unit. Preferably, two respective end stop brackets are provided at opposite lateral ends of the linkage mechanism that are configured to limit the pivoting motion of the cutting unit, thereby defining a start (swiveling) position and an end (swiveling) position. Basically, the at least one end stop beam may be laterally displaced or spaced from the four-bar linkage mechanism. The at least one end stop beam may be regarded as a substantially upwardly extending end stop beam.

The end stop support may comprise a plurality of end stop beams. For instance, a first and a second end stop beam may be arranged to limit the swiveling motion of the cutting unit. This can be performed by directly abutting or contacting the cutting unit or, optionally, by abutting or contacting the connecting bar of the four-bar linkage mechanism. Furthermore, the end stop support may further comprise a third and a fourth end stop beam that may be arranged to corporate with respective first and second arms of two sections of the four-bar linkage mechanism. The third and the fourth end stop beam may be provided with respective contact or abutment surfaces that are configured to limit the swiveling motion of the respective first and second arms with respect to the base of the four-bar linkage mechanism.

In still another embodiment, the at least one end stop element of the linkage unit comprises at least one protruding contact tab at at least one of the first arm, the second arm and the connecting bar, and at least one corresponding contact surface at the other one thereof, such that the at least one protruding contact and the at least one corresponding contact surface define a maximal relative rotation between first and second arms and the connecting bar. This arrangement may block or stiffen linkage mechanism and act as a load limiter for the hinges. Consequently, according to this embodiment, the at least one stop element may be regarded as a relative stop element, whereas the at least one stop element that can be fixedly arranged at the base of the four-bar linkage mechanism may be regarded as an absolute end stop element. It goes without saying that, in some embodiments, relative end stop elements and absolute end stop elements may be combined.

Another aspect of the present disclosure is directed to a hair cutting appliance comprising a housing accommodating a motor, a cutting unit, and a linkage unit in accordance with the principles of the present disclosure for coupling the cutting unit and the housing. Preferably, the linkage unit and a respective four-bar linkage mechanism thereof are formed in accordance with at least some of the aspects and embodiments discussed herein.

These and other features and advantages of the disclosure will be more fully understood from the following description of certain embodiments of the disclosure, taken together with the accompanying drawings, which are meant to illustrate and not to limit the disclosure.

BRIEF DESCRIPTION OF THE DRAWINGS

These and other aspects of the invention will be apparent from and elucidated with reference to the embodiments described hereinafter. In the following drawings

FIG. 2 is a perspective view of a first embodiment of a four-bar linkage mechanism for pivotably supporting a cutting unit, the mechanism being shown in a neutral position;

FIG. 3 is a simplified partial side view of a four-bar linkage mechanism similar to that one illustrated in FIG. 2 in a first pivoting position, e.g. an end position;

FIG. 4 is a further partial side view corresponding to the view of FIG. 3, the four-bar linkage mechanism shown in another pivoting position, e.g. a start position;

DETAILED DESCRIPTION OF THE INVENTION

Figure 1:
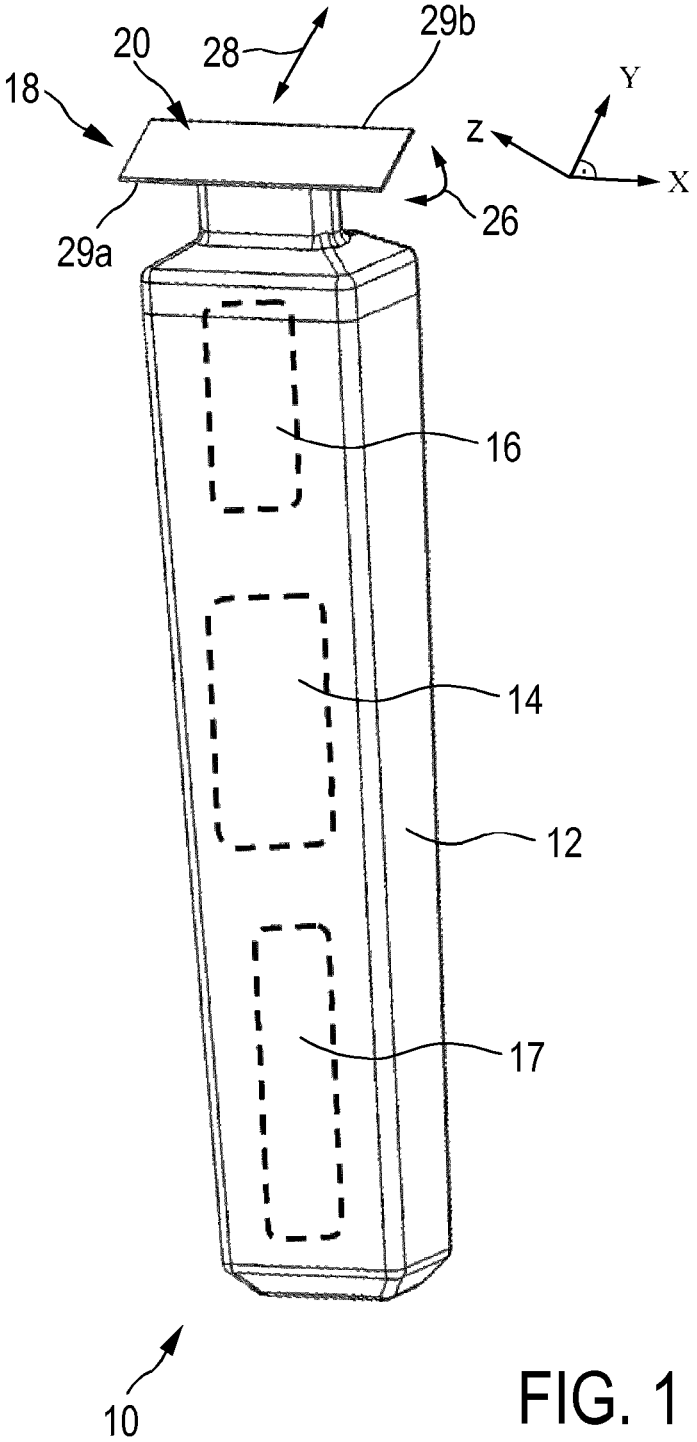
FIG. 1 shows a schematic perspective view of an exemplary electric hair cutting appliance fitted with an exemplary embodiment of a cutting unit that may be pivotably supported at the hair cutting appliance.

FIG. 1 schematically illustrates, in a simplified perspective view, an exemplary embodiment of a hair cutting appliance 10, particularly an electric hair cutting appliance 10. The cutting appliance 10 may include a housing 12, a motor indicated by a dashed block 14 in the housing 12, and a drive mechanism indicated by a dashed block 16 in the housing 12. For powering the motor 14, at least in some embodiments of the cutting appliance 10, an electrical battery, indicated by a dashed block 17 in the housing 12, may be provided, such as, for instance, a rechargeable battery, a replaceable battery, etc. However, in some embodiments, the cutting appliance 10 may be provided with a power cable for connecting a power supply. A power supply connector may be provided in addition or in the alternative to the (internal) electric battery 17.

The cutting appliance 10 may further comprise a cutting head or cutting unit 18. At the cutting unit 18, a blade set 20 may be attached to the hair cutting appliance 10. The blade set 20 of the cutting unit 18 may be driven by the motor 14 via the drive mechanism 16 to enable a cutting motion.

Figure 1A:
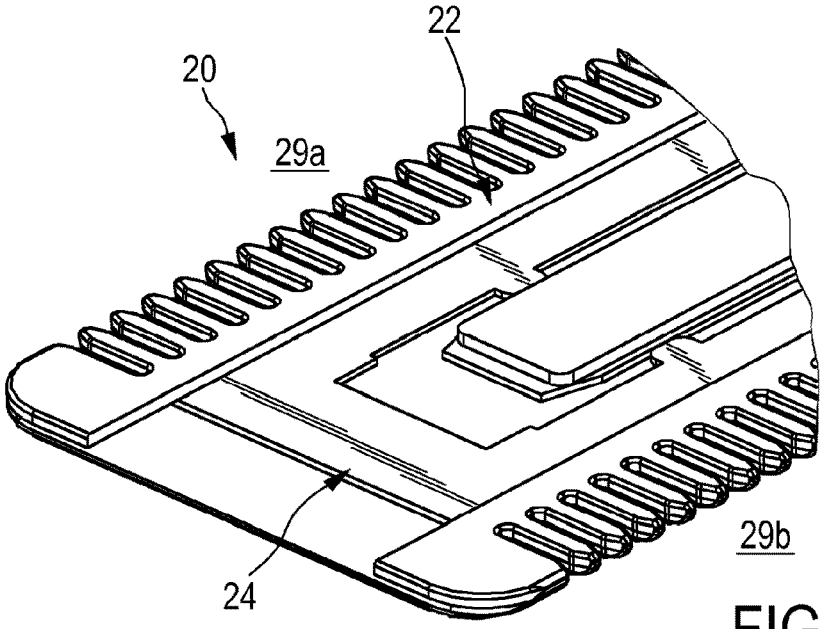
FIG. 1*a* is a partial perspective bottom view of a blade set of a cutting unit of a hair cutting appliance in accordance with FIG. 1.
Figure 1B:
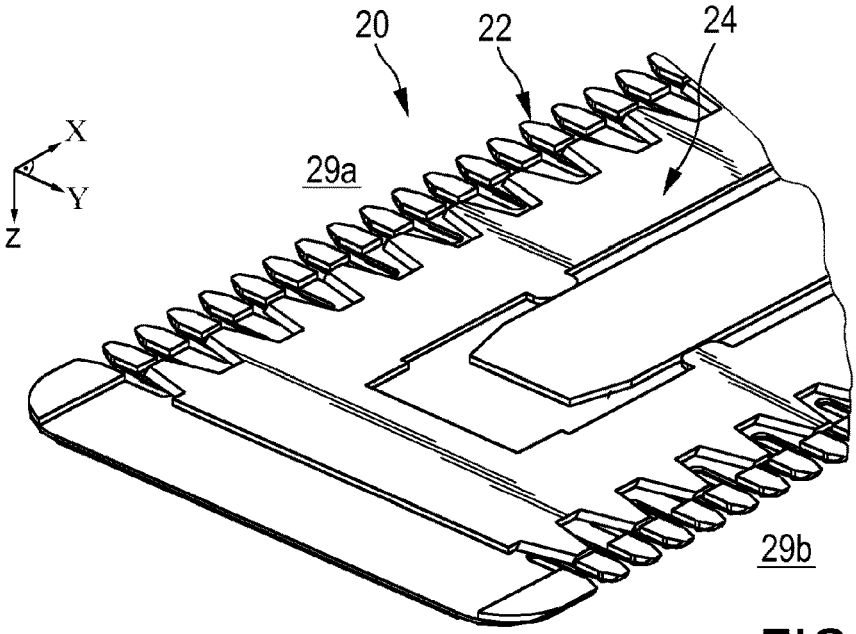
FIG. 1*b* is a further partial perspective bottom view corresponding to the view of FIG. 1*a*, a wall portion of the blade set being omitted primarily for illustrative purposes.

The cutting motion may be generally regarded as relative motion between a stationary blade 22 and a movable blade 24 of the blade set 20, see also FIGS. 1*a* and 1*b*. Generally, a user may grasp, hold and manually guide the cutting appliance 10 through hair in a moving direction 28 to cut hair. The cutting appliance 10 may be generally regarded as a hand-guided and hand-operated electrically powered device. Furthermore, the blade set 20 can be arranged at the cutting unit 18 in a pivoting manner, refer to the curved double-arrow indicated by reference numeral 26. In some embodiments, the cutting appliance 10, or, more specifically, the cutting unit 18 including the blade set 20, can be passed along skin to cut hair growing at the skin. When cutting hair closely to the skin, basically a shaving operation can be performed aiming at cutting (or chopping) at the level of the skin. However, also clipping (or trimming) operations may be envisaged, wherein the cutting unit 18 comprising a blade set 20 is passed along a path at a desired distance relative to the skin.

When being guided or led through hair, the cutting appliance 10 including the blade set 20 is typically moved along a common moving direction which is indicated by the reference numeral 28 in FIG. 1. It is worth mentioning in this connection that, given that the hair cutting appliance 10 is typically manually guided and moved, the moving direction 28 thus not necessarily has to be construed as a precise geometric reference and having a fixed definition and relation with respect to the orientation of the cutting appliance 10 and its cutting unit 18 fitted with the blade set 20. That is, an overall orientation of the cutting appliance 10 with respect to the to-be-cut hair at the skin may be construed as somewhat unsteady. However, for illustrative purposes, it can be fairly assumed that the (imaginary) moving direction 28 is parallel (or generally parallel) to a main central plane of a coordinate system which may serve in the following as a means for describing structural features of the hair cutting appliance 10.

For ease of reference, coordinate systems are indicated in several of FIGS. 1 to 10. By way of example, a Cartesian coordinate system X-Y-Z is indicated in FIG. 1. An X axis of the respective coordinate system extends in a generally longitudinal direction that is generally associated with length, for the purpose of this disclosure. A Y axis of the coordinate system extends in a lateral (or transverse) direction associated with width, for the purpose of this disclosure. A Z axis of the coordinate system extends in a height (or vertical) direction which may be referred to for illustrative purposes, at least in some embodiments, as a generally vertical direction. It goes without saying that an association of the coordinate system to characteristic features and/or embodiments of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective Figs. and illustrations including different orientations.

FIGS. 1*a* and 1*b* illustrate a partial detailed view of the blade set 20 of the cutting unit 18 exemplarily shown in FIG. 1. The blade set 20 comprises a stationary blade 22 and a movable blade 24. By way of example, the blade set 20 may comprise at least one basically longitudinally extending leading edge or cutting edge 29. It is preferred that the blade set 20 comprises two cutting edges 29*a*, 29*b* that are laterally spaced apart from each other. The cutting edges 29*a*, 29*b* may be spaced from each other in the moving direction 28 that is basically parallel to the lateral direction Y. The stationary blade 22 and the movable blade 24 may comprise a basically flat shape. It is particularly preferred that the stationary blade 22 is arranged to house and to guide the movable blade 24. In other words, the stationary blade 22 may be regarded as a shell or a cage for the movable blade 24. The stationary blade 22 may comprise a cross-section, viewed in the plane perpendicular to the lateral direction Y, that is basically U-shaped, particularly at the at least one cutting edge. The U shaped form may comprise a first leg and a second leg. Between the first leg and the second leg a guiding slot for the movable blade 24 may be defined. The movable blade 24 can be housed and guided in the stationary blade 22 for longitudinal movement with respect to the stationary blade 22. The movable blade 24 and the stationary blade 22 may comprise respective teeth at their cutting edges that allow cutting of hairs in a scissor-like action. The stationary blade 22 basically encloses the movable blade 24 at the side thereof facing the skin when cutting hair and, at least partially, at the side thereof facing away from the skin when cutting hair.

So as to suitably adapt the blade set 20 to shaving operations, it is preferred that a general height (or thickness) of the blade set 20, at least at the at least one cutting edge, is relatively small. Particularly, it is preferred that a skin-sided portion of the stationary blade 22 has a thickness that is relatively small. Even more preferably, the thickness of the stationary blade portion facing the skin is significantly smaller than the thickness of the stationary blade portion facing away from the skin, at least at the cutting edge. An exemplary blade set 20 for the hair cutting appliance 10 may comprise an overall height or thickness in the range of about 0.3 mm to about 0.75 mm. The height or thickness of the skin-facing portion of the stationary blade 22, at least at the at least one cutting edge, may be in the range of about 0.04 mm to about 0.25 mm. The height or thickness of the stationary blade portion facing away from the skin may be in the range of about 0.08 mm to about 0.4 mm. The height thickness of the movable blade 24, at least at the least one cutting edge, may be in the range of about 0.05 mm to about 0.5 mm. The height of the movable blade 24 may basically correspond to a height of the guiding slot defined by the stationary blade 22 for the movable blade 24.

It is particularly preferred that the cutting unit 18 including the blade set 20 is pivoted or pivotably supported at the housing 12 of the hair cutting appliance 10. To this end, a linkage unit 30 in accordance with the principles of the present disclosure may be utilized. Reference is made in this regard to FIGS. 2, 3 and 4. FIG. 2 illustrates a perspective view of a first embodiment of the linkage unit 30 that is configured to support the cutting unit 18. The linkage unit 30 may comprise a four-bar linkage mechanism 32 that is arranged between the blade set 20 and the housing 12 of the cutting appliance 10, refer to FIG. 1. With further reference to FIG. 2, the linkage unit 30 is further detailed and exemplarily shown as comprising a first linkage section 34 and a second linkage section 36. The first linkage section 34 and the second linkage section 36 may be spaced from each other in the lateral direction Y. However, it may be envisaged that in some embodiments the four-bar linkage mechanism 32 basically comprises a single linkage section. The four-bar linkage mechanism 32 may be configured so as to permit a swiveling or pivoting motion of the cutting unit 18 about a (virtual) axis p that is a basically parallel to the Y-axis and, consequently, basically parallel to the at least one cutting edge 29*a*, 29*b*, refer also to FIG. 9 in this connection. A resulting swiveling motion during operation, e.g., when following an actual skin contour, is indicated in FIGS. 3 and 4 by respective double-arrows 26. FIG. 4 may indicate a first position, particularly an end position. FIG. 3 may indicate a second position, particularly a start position.

The four-bar linkage mechanism 32 or, in some embodiments, each linkage section 34, 36 thereof, may comprise a base 38. In accordance with the exemplary embodiment shown in FIGS. 2, 3 and 4, the base 38 may comprise a first base portion 40*a* and a second base portion 40*b*. The base portions 40*a* and 40*b* may be spaced from each other in the lateral direction Y. Generally, the base 38 may be coupled or connected to the housing 12 of the hair cutting appliance 10 without considerable play during operation, such that basically no relative motion between the base 38 and the housing 12 is permitted. The four-bar linkage mechanism 32 or each respective linkage section 34, 36 thereof may further comprise a first arm 42 and a respective second arm 44. The first arm 42 and the second arm 44 may be spaced from each other in the lateral direction Y. Furthermore, a connecting bar 46 may be provided to which the blade set 20 of the cutting unit 18 is connected or coupled. The respective members of the four-bar linkage mechanism 32 may be movably or pivotably connected by respective pivots 48, 50, 52, 54. A first base pivot 48 may be arranged to connect the first arm 42 and the base 38 for a respective base portion 40*a* thereof. The second base pivot 50 may be arranged to connect the second arm 44 and the base 38 or a respective base portion 40*b* thereof. The first top pivot 52 may be configured to connect the first arm 42 and the connecting bar 46. Similarly, the second top pivot 54 may be configured to connect the second arm 44 and the connecting bar 46. Consequently, the top pivots 52, 54 may be spaced from the base pivots 50, 52 in the vertical direction Z.

At least one or, more preferably, each of the pivots 48, 50, 52, 54 may be arranged as a living hinge. Particularly, the pivots 48, 50, 52, 54 may be arranged as film hinges. In other words, the base 38 including the base portions 40*a*, 40*b*, the first arm 42, the second arm 44 and the connecting bar 46 including their interposed pivots 48,50, 52, 54 may be integrally manufactured as a single piece, refer also to FIGS. 3 and 4. For instance, the four-bar linkage mechanism 32 may be formed as a single injection-molded part. As can be best seen in FIG. 2, the first linkage section 34 and the second linkage section 36 may be integrally formed as well. However, in the alternative, each of the first linkage section 34 and the second linkage section 36 may be formed as separate integrally-shaped part.

As can be further seen from FIG. 2, the connecting bar 46 may further comprise at least one side arm 56, particularly a first side arm 56*a* and a second side arm 56*b* that may be coupled to the blade set 20. Each of the side arms 56*a*, 56*b* may extend outwardly from the connecting bar 46. The at least one side arm 56*a*, 56*b* may be inclined with respect to the connecting bar 46, and to the blade set 20. It is worth noting in this connection that, as discussed and described herein, structural features and relationships may typically refer to the neutral position (or centered position) of the linkage unit 30 as shown, for instance, in FIGS. 2, 5 and 9, unless otherwise indicated.

FIG. 2 further illustrates an optional limit stop arrangement that may be regarded as relative limit stop arrangement. The limit stop arrangement comprises at least one contact tab 58, 60. As can be seen from FIG. 2, two corresponding contact tabs 58, 60 may be provided. A first contact tab 58 is provided at the first arm 42 and projects therefrom. A second contact tab 60 is provided at the connecting bar 46 or, more specifically, at the first side arm 56*a* thereof in a laterally protruding manner. Each of the contact tabs 58, 60 may cooperate with a respective contact surface of an opposing component. The contact tabs 58, 60 may cooperate so as to limit a relative pivoting motion between the connecting bar 46 and the first arm 42 about a pivoting axis defined by the hinge defining the first top pivot 52. When the first contact tab 58 and the second contact tab 60 contact or abut each other also general motion of the four-bar linkage mechanism 32 beyond the limit defined by the contact tab 58 and the contact tab 60 is basically prevented. Preventing excessive motion of the four-bar linkage mechanism 32 is beneficial since in this way excessive strain in the pivots 48, 50, 52, 54 can be avoided. Furthermore, the cutting unit 18 can be prevented from assuming undesired orientations, e.g., exaggerated swivel angles, that might increase the risk of skin irritation or even of skin cuts during operation. Preferably, at least two pairs of contact tabs 58, 60 are provided at the linkage mechanism 32 (not explicitly shown in FIG. 2).

Figure 5:
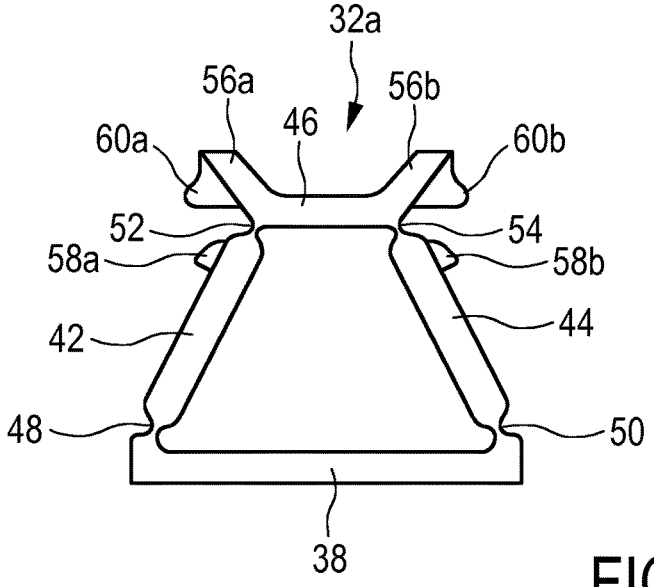
FIG. 5 illustrates a simplified side view of another embodiment of a four-bar linkage mechanism shown in a near-net shaped state.

With particular reference to FIG. 5, an alternative embodiment of a four-bar linkage mechanism 32*a* is illustrated and further detailed. Similarly to the four-bar linkage mechanism 32 shown in FIG. 2, the four-bar linkage mechanism 32*a* illustrated in FIG. 5 comprises a base 38, a first arm 42, a second arm 44 and a connecting bar 46 that are coupled by respective first and second base pivots 48, 50 and first and second top pivots 52, 54. In contrast to the embodiment shown in FIG. 2, the base 38 is shaped as an integral component continuously (or directly) connecting the first base pivot 48 and the second base pivot 50. The four-bar linkage mechanism 32*a* exemplified in FIG. 5 is arranged as a closed arrangement or closed chain. By contrast, the four-bar linkage mechanism 32 exemplified in FIG. 2 is shaped as an open arrangement or an open chain. With further reference to FIG. 5, the four-bar linkage mechanism 32*a* is further detailed. An end stop arrangement is provided adding a first pair of contact tabs 58*a*, 60*a* at the first arm side of the mechanism 32*a*. The end stop arrangement further comprises a second pair of contact tabs 58*b*, 60*b* arranged at the second arm side of the mechanism 32*a*. Consequently, the pivoting motion of the four-bar linkage mechanism 32*a* can be limited both when moving forward and when moving back between a start position and an end position.

It is particularly preferred that, in one embodiment, the four-bar linkage mechanism 32*a* shown in FIG. 5 is injection-molded, particularly as a three-dimensional near-net shaped molded part. Consequently, the four-bar linkage mechanism 32*a* and the respective linkage unit may be ready to install after the molding process. Costly finishing steps, alignment steps and effortful assembly steps can be prevented in this way.

Figure 6A:
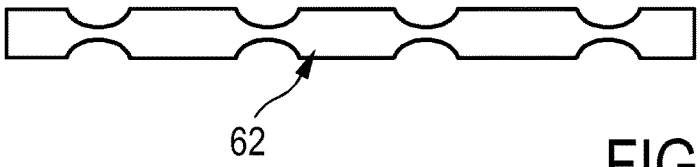
FIG. 6*a* illustrates a simplified side view of an injection molded intermediate arrangement from which a four-bar linkage mechanism may be formed.
Figure 6B:
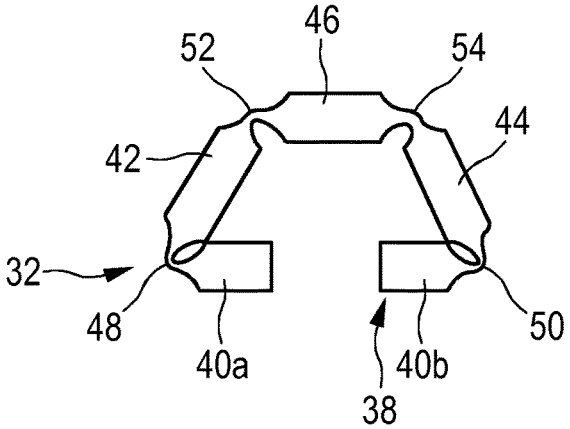
FIG. 6*b* is a further simplified schematic side view of a four-bar linkage mechanism that has been formed from a basically flat intermediate arrangement, as shown in FIG. 6*a;*

However, in some alternative embodiments, another manufacturing approach may be pursued. As best shown in FIG. 6*a*, a precursor or intermediate part of a four-bar linkage mechanism 32 may be formed, particularly injection-molded as a generally flat intermediate arrangement 62. The intermediate arrangement 62 may comprise at least one thinned recess 64. The at least one thinned 64 recess may define, later on, the respective pivots 48, 50, 52, 54 of the four-bar linkage mechanism 32. The initially basically flat intermediate arrangement 62 of FIG. 6*a* is shown in FIG. 6*b* at an advanced manufacturing stage. By deforming, particularly bending, the intermediate arrangement 62, a basically three-dimensional shape of the four-bar linkage mechanism 32 may be achieved. FIG. 6*b* further illustrates an exemplary open-chain arrangement of the four-bar linkage mechanism 32.

Figure 7:
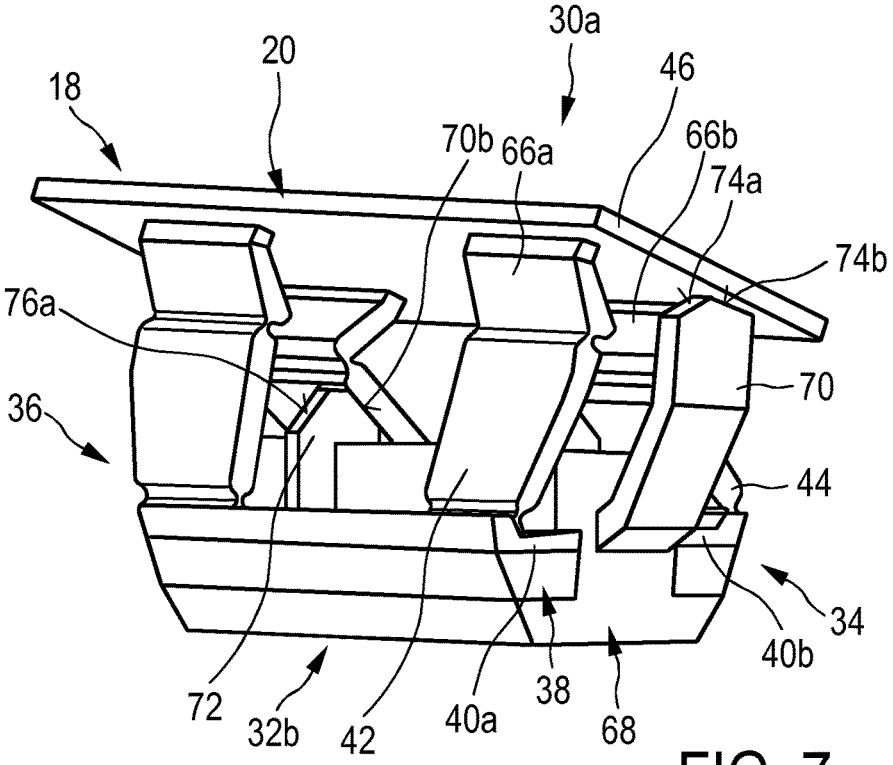
FIG. 7 is a simplified perspective view of another embodiment of a linkage unit for pivotably supporting a cutting unit of a hair cutting appliance the linkage unit being shown in a start position.
Figure 8:
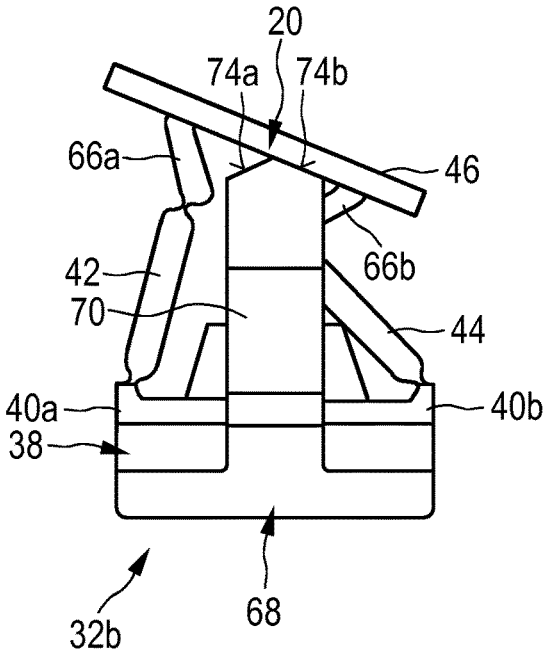
FIG. 8 is a simplified side view of the embodiment shown in FIG. 7.

FIG. 7 and FIG. 8 illustrate another alternative embodiment of a linkage unit 30*a*. The linkage unit 30*a* may comprise a four-bar linkage mechanism 32*b* that is basically formed in accordance with at least some of the principles of the embodiments shown in FIGS. 1 to 6*b*. However, the four-bar linkage mechanism 32*b* may differ therefrom in that the connecting bar 46, or in other words, the top coupling portion thereof, may be formed by the cutting unit 18 itself. In other words, the four-bar linkage mechanism 32*b* may comprise a first connecting arm 66*a* connected to the first arm 42 via the first top pivot 52 and a second connecting arm 66*b* connected to the second arm 44 via the second top pivot 54. The first connecting arm 66*a* and the second connecting arm 66*b* are (mediately) fixedly connected to each other via the cutting unit 18. More particularly, the first connecting arm 66*a* and the second connecting arm 66*b* are basically prevented from relative motion. This embodiment may further allow splitting the four-bar linkage mechanism 32*b* into two laterally spaced-apart parts.

The linkage unit 30*a* further comprises an absolute end stop arrangement. The end stop arrangement may comprise an end stop support 68. The end stop support 68 may comprise at least one end stop beam 70, 72. Preferably, a first pair of outer end stop beams 70 is provided. Accordingly, a second pair of inner end stop beams 72 may be provided. The end stop beam 70 may be arranged to directly or indirectly corporate with the connecting bar 46 to limit a respective swiveling or pivoting motion thereof. The end stop beam 72 may be configured to corporate with at least one of the first arm 42 and the second arm 44 to limit a respective swiveling or pivoting motion thereof. At least one end face 74*a*, 74*b* may be provided at the end beam 70. At least one end face 76*a*, 76*b* may be provided at the end beam 72.

The at least one end face 74*a*, 74*b* of the end beam 70 may be arranged to contact or abut a respective contact surface that is associated to the connecting bar 46. The at least one end face 76*a*, 76*b* of the end beam 72 may be arranged to contact or abut a corresponding contact surface at at least one of the first arm 42 and the second arm 44. The absolute end stop arrangement illustrated in FIGS. 7 and 8 may be beneficial insofar as excessive motion can be limited by external components that are separate from the moving components of the four-bar linkage mechanism 32*b*. Both FIG. 7 and FIG. 8 illustrate the four-bar linkage mechanism 32 *b* in a start position.

Figure 9:
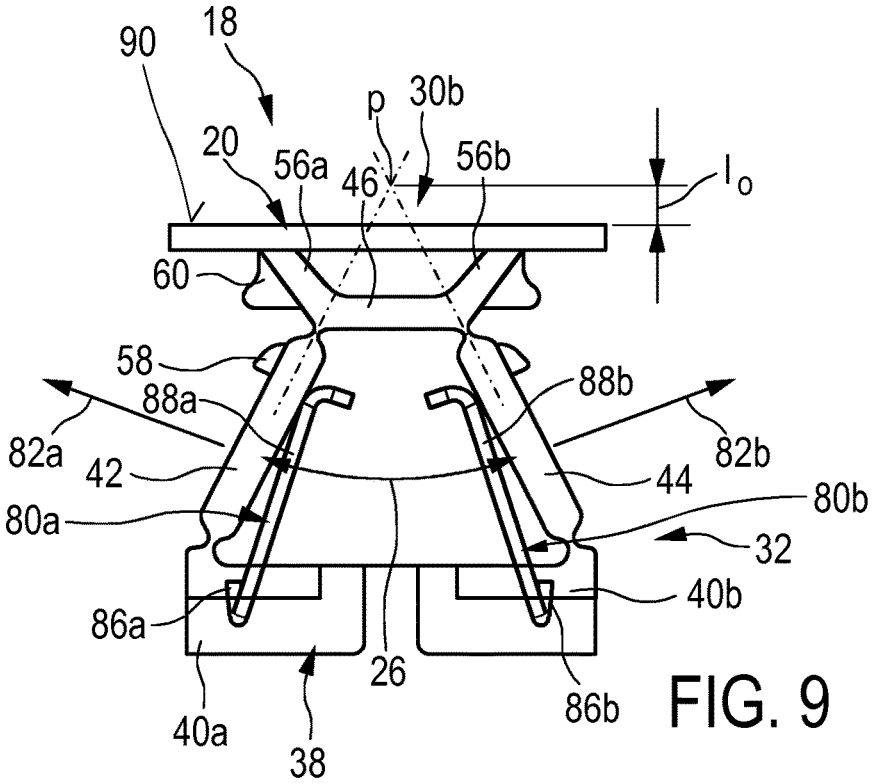
FIG. 9 is a simplified side view of yet another embodiment of a linkage unit for pivotably supporting a cutting unit of a hair cutting appliance, the linkage unit being shown in a neutral position.
Figure 10:
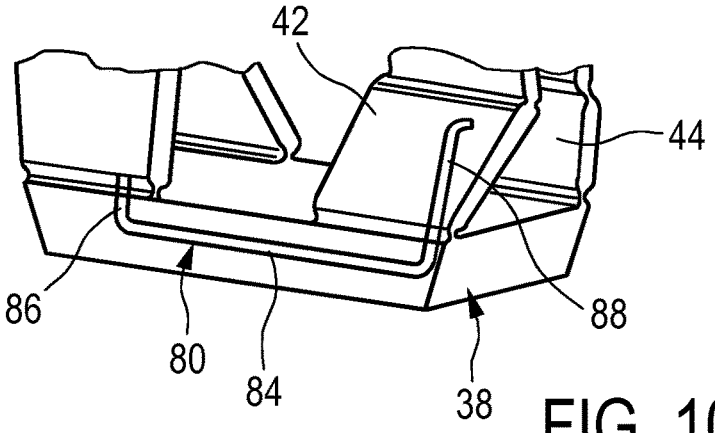
FIG. 10 is a simplified schematic partial perspective view of the embodiment shown in FIG. 9, wherein a basically hidden biasing element is shown, primarily for illustrative purposes.

With particular reference to FIG. 9 and FIG. 10, yet another exemplary embodiment of a linkage unit 30*b* is exemplified. The linkage unit 30*b* may comprise a four-bar linkage mechanism 32 that may basically correspond to the embodiment of the four-bar linkage mechanism 32 illustrated in FIG. 2. Apart from that, the linkage unit 30*b* further comprises at least one biasing element 80*a*, 80*b*. Particularly, a first biasing element 80*a* associated with the first arm 42 may be provided. The first biasing element 80*a* may be configured to urge the first arm 42 in a first biasing direction 82*a*. In some embodiments, a second (support) biasing element 80*b* associated with the second arm 44 may be provided. The second biasing element 80*b* may be configured to urge the second arm 44 in a second biasing direction 82*b*. The first biasing direction 82*a* and the second biasing direction 82*b*, the biasing elements 80*a*, 80*b* may basically bias the first arm 42 and the second arm 44 in opposing directions 82*a*, 82*b*. The biasing elements 80*a* may ensure that the four-bar linkage mechanism 32 returns to the start position illustrated in FIG. 8 after being pivoted when in operation. The biasing element 80*a* may ensure a basically free-of-play support of the linkage mechanism 32.

As can be schematically seen from FIG. 10, the at least one biasing element 80*a*, 80*b* may be configured as a torsion bar spring 80, for example. The torsion bar spring 80 may comprise torsion bar 84 and a first leg 86 and a second leg 88 provided at respective ends of the torsion bar 84. A side view of similar arrangements of the first biasing element 80*a* and the second biasing element 80*b* is illustrated in FIG. 9.

Particularly the torsion bar 84 of the torsion bar spring 80 can be mounted at the base 38. Furthermore, the first leg 86 may be fixed in the base 38 against undesired rotation about an excessive find by the torsion bar 84. The torsion bar spring 80 may be designed and shaped such that upon mounting the torsion bar 84 at the base 38 and fixing the first leg 86 at the base 38 the second leg 88 can biased against the first arm 42.

As can be best seen from FIG. 9, the at least one biasing element 80*a*, 80*b* can be arranged in the vicinity of or, proximate to the respective first arm 42 and the second arm 44 of the four-bar linkage mechanism 32. Consequently, a central portion of the linkage mechanism 32 can be kept free and unobstructed such that sufficient design space is provided for driving the movable blade of the blade set 20 of the cutting unit 18. It may be further envisaged that each of the linkage sections 34, 36 (refer to FIG. 2) is associated with a respective first biasing element 80*a* that is configured to urge the linkage mechanism into the start position.

As can be further seen from FIG. 9, the four-bar-linkage mechanism 32, at least in some preferred embodiments, may be designed such that a resulting virtual pivot axis p defined is basically parallel to the at least one toothed cutting edge 29*a*, 29*b*, refer also to FIGS. 1*a* and 1*b*. Furthermore, the four-bar-linkage mechanism 32 may be configured to include a pivot axis p that is, at least in the neutral position illustrated in FIG. 9, offset from a skin-facing side of the blade set 20 in the vertical direction Z towards the skin. The skin-facing side may be also referred to as top surface 90 for the purpose of this disclosure. A corresponding offset dimension $l_o$ is illustrated in FIG. 9. In other words, the (virtual) pivot axis p of the four-bar-linkage mechanism 32 may be shifted "into" the skin in some embodiments. This may further improve the shaving performance. Such a configuration cannot be achieved with conventional real structural pivot arrangements. However, in some alternative embodiments, the virtual pivot p may be arranged above the skin level, i.e. below the level of the top surface 90. It is preferred that the pivot offset dimension $l_o$ is, at least in the neutral position, in the range of about −2.0 mm to about +5.0 mm, preferably in the range of about −1.0 mm to about +2.0 mm, more preferably in the range of about +0.25 mm to about +0.75 mm. As used herein, + (plus) refers to an arrangement, wherein the pivot axis p is positioned above the level of the top surface 90, i.e. shifted "into" the skin. By contrast, − (minus) refers to an arrangement, wherein the pivot axis p is positioned below the level of the top surface 90, i.e. above the skin.

Figure 11:
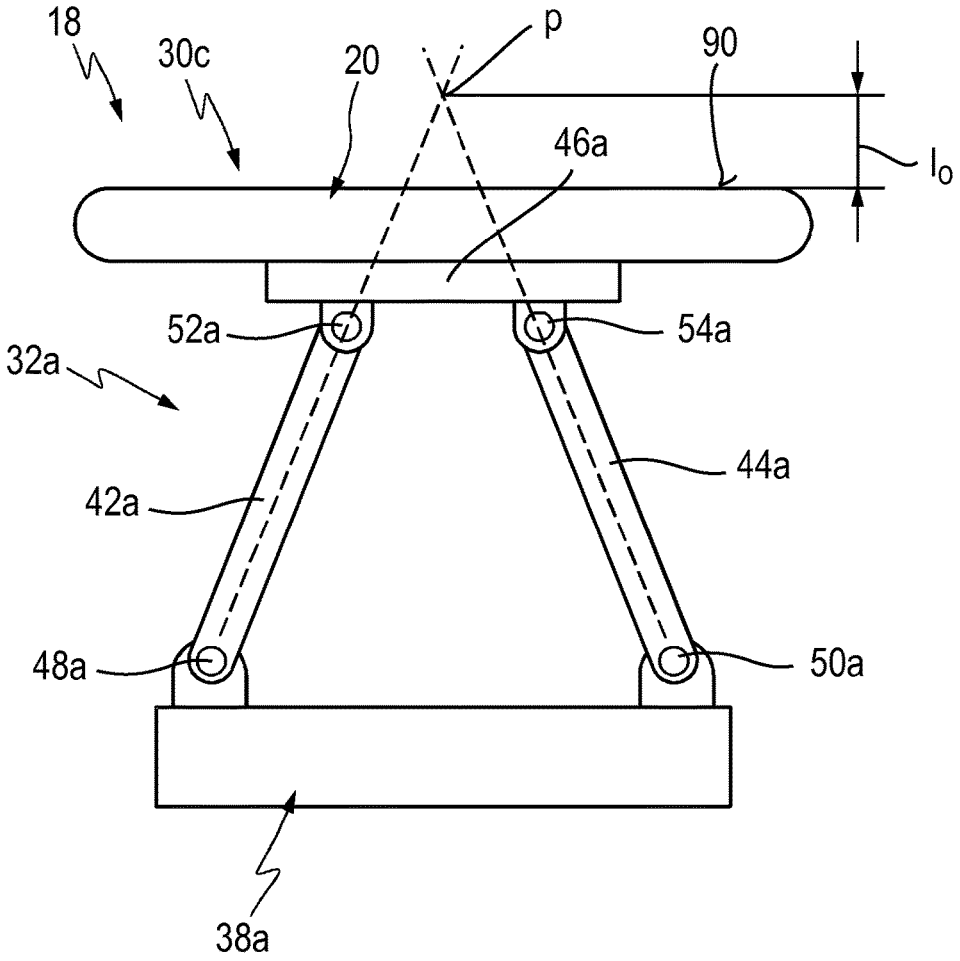
FIG. 11 is a simplified side view of yet another embodiment of a linkage unit for pivotably supporting a cutting unit of a hair cutting appliance, the linkage unit being shown in a neutral position.

With particular reference to FIG. 11, another alternative embodiment of a linkage unit 30*c* for pivotably connecting a cutting unit 18 and a housing 12 of a hair cutting appliance 10 (refer also to FIG. 1) is illustrated and further detailed. The linkage unit 30*c* comprises a four-bar-linkage mechanism 32*a* that is provided with at least one pivot joint that may comprise a pivot pin that cooperates with two to-be-coupled elements, e.g. via at least one respective distinct pivot seat. The pivot pin can be received at the at least one pivot seat. The pivot pin and the pivot seat may cooperate so as to define a pivot bearing.

The four-bar-linkage mechanism 32*a* comprises a base 38*a*, a first arm 42*a*, a second arm 44*a*, and a connecting bar 46*a*. The base 38*a* is interposed between the first arm 42*a* and the second arm 44*a* at a base end thereof. The connecting bar 46*a* is interposed between the first arm 42*a* and the second arm 44*a* at a top end thereof. Between the base 38*a* and the first arm 42*a*, a first base pivot or base pivot joint 48*a* may be provided. Between the base 38*a* and the second arm 44*a*, a second base pivot or base pivot joint 50*a* may be provided. Between the connecting bar 46*a* and the first arm 42*a*, a first top pivot or top pivot joint 52*a* may be provided. Between the connecting bar 46*a* and the second arm 44*a*, a second top pivot or top pivot joint 54*a* may be provided. It goes without saying that at least one of the pivots 48*a*, 50*a*, 52*a*, 54*a* may be provided as a living hinge. However, it may be preferred in connection with the embodiment shown in FIG. 11 that each of the pivots 48*a*, 50*a*, 52*a*, 54*a* is an assembled pivot joint comprising at least one distinct part that is not integrally formed with both respective the to-be-coupled elements.

Also the four-bar-linkage mechanism 32*a* of FIG. 11 may define a virtual pivot axis p that is, in the neutral position (or middle position) illustrated in FIG. 11, offset from a top surface 90 of the blade set 20 by a pivot offset dimension $l_o$, as discussed above.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the stationary blade, the blade set, etc. according to the present disclosure. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A cutting unit and a linkage unit for a hair cutting appliance, wherein the cutting unit is arranged to be coupled to a housing of the hair cutting appliance by the linkage unit, the cutting unit comprising a blade set comprising a stationary blade, a movable blade and at least one basically longitudinally extending cutting edge, wherein the stationary blade is arranged to house and to guide the movable blade for longitudinal movement with respect to the stationary blade, the stationary blade comprising a cross-section, viewed in a plane perpendicular to a lateral direction (Y), that is U-shaped at the at least one cutting edge, wherein the U-shaped form comprises a first leg and a second leg, wherein a guiding slot for the movable blade is provided between the first leg and the second leg, and wherein the stationary blade basically encloses the movable blade at a side thereof facing a skin when cutting hair and, at least partially, at a side thereof facing away from the skin when cutting hair, the linkage unit comprising a four-bar linkage mechanism, the four-bar linkage mechanism comprising a first arm and a second arm opposite to the first arm, the first arm comprising a first base pivot coupled to a base, the second arm comprising a second base pivot coupled to the base, the first base pivot and the second base pivot being arranged at the base at a defined distance, the first arm further comprising a first top pivot coupled to a connecting bar, the second arm further comprising a second top pivot coupled to the connecting bar, wherein the connecting bar is arranged to be coupled to the cutting unit, such that, during operation, the cutting unit is pivotably supported by the linkage mechanism, and wherein the cutting unit and the linkage unit further comprise at least one end stop element for preventing undesired motion of the four-bar linkage mechanism, wherein the at least one end stop element comprises at least one protruding contact tab at at least one of the first arm, the second arm and the connecting bar, and at least one corresponding contact surface at the other one of the first arm, the second arm and the connecting bar, such that the at least one protruding contact tab and the at least one corresponding contact surface define a maximal relative rotation between the first and second arms and the connecting bar.

2. The cutting unit and the linkage unit as claimed in claim 1, wherein the four-bar linkage mechanism defines a virtual pivot for the cutting unit, the virtual pivot comprising a virtual pivot axis (p) that is substantially parallel to the cutting edge of the cutting unit.

3. The cutting unit and the linkage unit as claimed in claim 2, wherein the pivot axis is arranged in a vicinity of a top surface of the cutting unit facing away, when mounted, from the housing of the hair cutting appliance, and wherein the pivot axis is offset from the top surface, in a neutral position of the four-bar linkage mechanism, by a pivot offset dimension in a range of between −2.0 mm and +5.0 mm below and above a level of the top surface.

4. The cutting unit and the linkage unit as claimed in claim 2, wherein the pivot axis is arranged in a vicinity of a top surface of the cutting unit facing away, when mounted, from the housing of the hair cutting appliance, and wherein the pivot axis is offset from the top surface, in a neutral position of the four-bar linkage mechanism, by a pivot offset dimension in a range of between −1.0 mm and +2.0 mm below and above a level of the top surface.

5. The cutting unit and the linkage unit as claimed in claim 2, wherein the pivot axis is arranged in a vicinity of a top surface of the cutting unit facing away, when mounted, from the housing of the hair cutting appliance, and wherein the pivot axis is offset from the top surface, in a neutral position of the four-bar linkage mechanism, by a pivot offset dimension in a range of between +0.25 mm and +0.75 mm below and above a level of the top surface.

6. The cutting unit and the linkage unit as claimed in claim 1, wherein at least the first arm, the second arm and the connecting bar and their respective base pivots and top pivots are integrally formed as a single piece.

7. The cutting unit and the linkage unit as claimed in claim 6, wherein all pivots of the four-bar linkage mechanism are arranged as living hinges.

8. The cutting unit and the linkage unit as claimed in claim 1, wherein the four-bar linkage mechanism is an integrally formed injection molded plastic part.

9. The cutting unit and the linkage unit as claimed in claim 1, wherein the four-bar linkage mechanism is a three-dimensional near-net shaped molded part, and wherein hinges forming the pivots thereof are basically unbiased when the linkage mechanism is in a neutral position.

10. The cutting unit and the linkage unit as claimed in claim 1, wherein the length of the base, defined by a distance between the first base pivot and the second base pivot, is greater than the length of the connecting bar, defined by a distance between the first top pivot and the second top pivot.

11. The cutting unit and the linkage unit as claimed in claim 1, further comprising at least one biasing element that urges the four-bar linkage mechanism into a defined start position.

12. The cutting unit and the linkage unit as claimed in claim 11, wherein the at least one biasing element is a torsion bar spring arranged at the base, the torsion bar spring comprising a torsion bar pivotably received at the base, the torsion bar being arranged between a first leg and a second leg, wherein the first leg is coupled to the base, and wherein the second leg is coupled to one of the first arm and the second arm.

13. The cutting unit and the linkage unit as claimed in claim 1, wherein the at least one end stop element cooperates with at least one biasing element, wherein a resulting biasing force urges the four-bar linkage mechanism against at least one of the at least one end stop element.

14. The cutting unit and the linkage unit as claimed in claim 1, wherein the at least one end stop element is connected to the base and arranged to limit a motion of the cutting unit.

15. The cutting unit and the linkage unit as claimed in claim 1, wherein the at least one end stop element is arranged at an end stop support comprising at least one end stop beam, the at least one end stop beam comprising at least one end face, wherein the at least one end face abuts a bottom side of the cutting unit for limiting the motion of the cutting unit.

16. The cutting unit and the linkage unit as claimed in claim 1, wherein the at least one end stop element is connected to the base and arranged to limit motion of at least one of the first arm, the second arm and the connecting bar.

17. A hair cutting appliance comprising a housing accommodating a motor, a cutting unit, and a linkage unit for coupling the cutting unit and the housing, wherein the linkage unit comprises a four-bar linkage mechanism, the four-bar linkage mechanism comprising a first arm and a second arm opposite to the first arm, the first arm comprising a first base pivot coupled to a base, the second arm comprising a second base pivot coupled to the base, the first base pivot and the second base pivot being arranged at the base at a defined distance, the first arm further comprising a first top pivot coupled to a connecting bar, the second arm further comprising a second top pivot coupled to the connecting bar, wherein the connecting bar is arranged to be coupled to the cutting unit, such that, during operation, the cutting unit is pivotably supported by the linkage mechanism, and wherein the cutting unit and the linkage unit further comprise at least one end stop element for preventing undesired motion of the four-bar linkage mechanism, wherein the at least one end stop element comprises at least one protruding contact tab at at least one of the first arm, the second arm and the connecting bar, and at least one corresponding contact surface at the other one of the first arm, the second arm and the connecting bar, such that the at least one protruding contact tab and the at least one corresponding contact surface define a maximal relative rotation between the first and second arms and the connecting bar.

* * * * *